United States Patent [19]

McIlvanie

[11] 4,062,412

[45] Dec. 13, 1977

[54] FLEXIBLE SHAFT DRILLING SYSTEM

[75] Inventor: William A. McIlvanie, Yakima, Wash.

[73] Assignee: The United States of America as represented by the Secretary of the Interior, Washington, D.C.

[21] Appl. No.: 653,315

[22] Filed: Jan. 29, 1976

[51] Int. Cl.[2] ..... E21C 1/10; E21C 11/00

[52] U.S. Cl. ..... 175/57; 64/2 R; 173/34; 173/150; 175/78

[58] Field of Search ..... 64/2 R; 173/34, 113, 173/149, 150, 145; 175/61, 81, 103, 386, 52, 78; 408/48, 127

[56] References Cited

U.S. PATENT DOCUMENTS

| | | | |
|---|---|---|---|
| 2,147,214 | 2/1939 | Perebaskine et al. | 175/78 X |
| 2,644,669 | 7/1953 | Curtis et al. | 175/61 |
| 2,743,082 | 4/1956 | Zublin | 175/61 |
| 2,839,270 | 6/1958 | McCune et al. | 175/61 |
| 2,889,137 | 6/1959 | Walker | 175/78 X |
| 2,964,296 | 12/1960 | Cluff | 173/145 |
| 3,354,969 | 11/1967 | Ebeling | 175/103 |
| 3,493,058 | 2/1970 | Zitko | 173/34 |
| 3,721,094 | 3/1973 | Elders et al. | 173/34 |
| 3,817,336 | 6/1974 | Sears | 175/61 |
| 3,930,545 | 1/1976 | Sears | 175/61 |

*Primary Examiner*—Ernest R. Purser
*Attorney, Agent, or Firm*—Thomas Zack; Donald A. Gardiner

[57] ABSTRACT

In an apparatus for drilling long holes in the surface of a rock bed for installation of roof bolts where the working distance perpendicular to the surface is limited, a flexible, segmented shaft drill string is fed along a curved path to a mechanism positioned directly under the working surface. The mechanism straightens the drill string perpendicular to the surface, and supplies torque and thrust to the string to drill the holes. Since torque and thrust are supplied to only the straightened portion of the drill string, rather than to the curved portion, greater thrust is imparted to the drill head with minimum wear of the segments. A special guide sleeve, mounted to a rigid starter section of the drill string behind the head, guides the string along a straight path in the rock.

18 Claims, 7 Drawing Figures

FLEXIBLE SHAFT DRILLING SYSTEM

BACKGROUND OF THE INVENTION

The present invention relates generally to a flexible drill string system for drilling long holes in a mine roof, and more particularly to such a system wherein thrust and torque are supplied to a straightened portion of the drill string at the working surface of the roof to maximize torque and thrust components transmitted to the drill head.

High grade coal is generally mined underground in narrow seams of the coal between layers of sedimentary rock (usually shale or sandstone). The shale roof of the mine is commonly supported by a process known as roof bolting. This process involves drilling a hole (typically 1⅜ inch in diameter and 4–6 feet long) vertically into the shale. A nut is wedged tightly against the shale at the bottom of the hole into stable rock. Then a rock bolt having a length about equal to the length of the hole is inserted, threaded into the nut, and torqued down tightly against the roof. Thus, the unstable rock at the roof is clamped to the more stable rock above it.

A problem arises where a standard 72 inch long bolt hole has to be drilled into the roof of the mine, and the coal seam is only, e.g., 40 inches high. Obviously, a one-piece drill shaft is too long because it cannot be oriented perpendicular to the roof.

If the one-piece drill shaft is replaced by a flexible shaft formed of a series of interconnected drill segments, a problem arises in transmitting thrust to the drill head along the string for advancing the head into the rock. Since the drill string is perpendicular to the roof at the working surface, and extends downwardly and away from the working surface along a curve to fit within the limited height of the seam, torque and thrust supplied to the string at the end opposite the drill head is transmitted to the head along the curved portion of the drill string. Thus, only a fractional component of thrust reaches the head with the remainder being taken up in the curved portion of the drill string. Furthermore, since thrust and torque are transmitted to the head of the drill along all of the drill segments, excessive wear of the coupling members between segments is created, and this results in increased breakage and down time.

OBJECTIVES OF THE INVENTION

Accordingly, one object of the present invention is to provide a new and improved system for drilling long holes in a rock surface where a working distance perpendicular to the surface is limited.

Another object of the present invention is to provide a flexible shaft drilling system for drilling long holes in a rock surface where a working distance perpendicular to the surface is limited.

Another object of the present invention is to provide a new and improved system for driving a flexible shaft drill, wherein thrust applied to the drill head is maximized.

Yet another object of the present invention is to provide a new and improved system for driving a flexible shaft drill, wherein torque and thrust are applied to the drill head only at a straightened portion of the drill.

Still another object of the present invention is to provide a new and improved system for driving a flexible shaft drill, wherein torque and thrust are supplied to the drill at the rock surface.

Another object of the present invention is to provide a new and improved drive for a flexible shaft drill for rock, wherein both thrust and torque are supplied to the drill with a drive mechanism located at the working surface of the rock.

Yet another object of the present invention is to provide a new and improved drive for a flexible shaft drill, wherein wearing of individual drill segments is minimized.

Another object of the present invention is to provide a new and improved system for drilling long holes into rock, and collecting rock chips produced in the hole during drilling.

Still another object of the present invention is to provide a new and improved drive for a flexible shaft drill, wherein continuous rotation and intermittent thrust are supplied to a drill while the string is guided perpendicular to the rock surface.

Another object of the present invention is to provide a new and improved flexible drill system for drilling rock, wherein the drill is guided along a straight path within the rock.

Still other objects and advantages of the present invention will become readily apparent to those skilled in this art from the following detailed description, wherein I have shown and described only the preferred embodiment of the invention, simply by way of illustration of the best mode comtemplated by me of carrying out my invention. As will be realized, the invention is capable of other and different embodiments, and its several details are capable of modifications in various obvious respects, all without departing from the invention. Accordingly, the drawings and description are to be regarded as illustrative in nature, and not as restrictive.

SUMMARY OF THE INVENTION

Briefly, in accordance with the invention, a system for drilling long holes in a surface of a rock bed, where the working distance perpendicular to the surface is limited, comprises a drive mechanism located directly under the surface to be drilled for straightening a portion of a flexible shaft drill string at the surface and supplying thrust and torque to the string for drilling the hole. The drilling string comprises a plurality of rigid drill segments connected end-to-end and trailing out from the drive mechanism along a gentle arc to a region remote from the working surface. Since torque and thrust are supplied to only the straightened portion of the drill string at the working surface of the rock, maximum thrust is transmitted to the drill head.

The drill string includes a rigid starter section just behind the head of the drill. A pair of guide sleeves, located respectively at the ends of the starter section, each contains a series of vertical ribs for guiding the head along a straight path in the rock. The sleeves are mounted on ball or sleeve bearings to permit the starter section of the drill to freely rotate therein.

Each drill shaft segment is hollow with teeth formed along each of the opposite rims of the segment. The teeth formed on adjacent drill shaft segments engage each other for common rotation of the segments. The segments are enclosed in a resilient sleeve that protects the segments and maintains them in proper alignment to each other. Another resilient sleeve is contained within the hollow drill elements. This sleeve is supplied with negative pressure and serves as a return line for chips cut from the hole during drilling.

The drive mechanism, mounted to a vehicle (roof bolter) or stationary support directly under the portion of the mine roof to be drilled, comprises a rotating cylinder containing a reciprocating piston that rides a pair of vertical grooves or splines formed in the inner wall of the cylinder. The piston rotates with the cylinder but is free to reciprocate therein. A pair of pawl members, connected to an upper portion of the piston, successively engages corresponding apertures formed in each segment of the drill string. The pawl members and apertures function as a pawl and ratchet system for driving the drill string. The pawl members cause the drill string to rotate with the piston and cylinder, and to thrust into the hole as the piston is driven to the top of its stroke under hydraulic pressure. The pawl members also release from the apertures in the drill string during downstroke of the piston to provide the ratcheting function while a holding pin maintains the drill string up into the hole. The result is that continuous rotation and intermittent thrust are simultaneously supplied to the drill string at the rock surface.

DETAILED DESCRIPTION OF A PREFERRED EMBODIMENT

Figure 1:
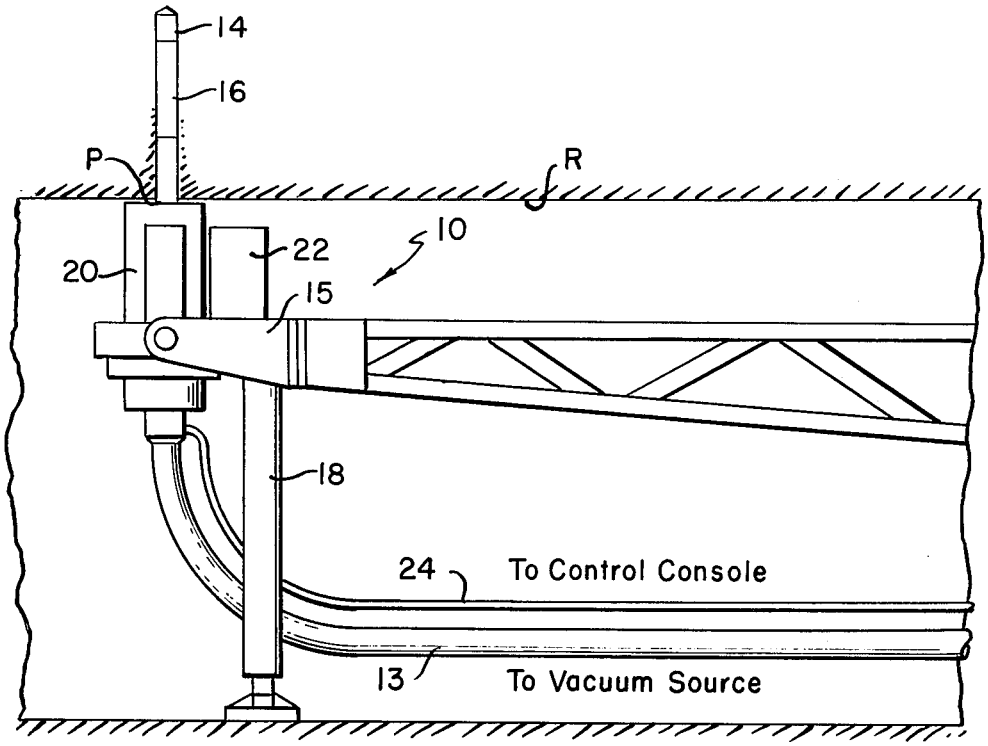
FIG. 1 is a simplified diagram of the invention mounted on a support member in a mine.

Referring to FIG. 1, an apparatus 10 for drilling a long hole P in the roof R of a mine comprises a drive mechanism 20 mounted to a support 15 on a hydraulic jack 18. Drive mechanism 20, located directly under hole P, straightens a flexible shaft drill string 13 perpendicular to roof R, and transmits torque and thrust from motor 22 to the string for drilling the hole. Since the torque and thrust are applied to the straightened portion of the drill string 13 at the roof R, rather than to the tail end of the spring opposite the drill head, the head of the drill receives maximum thrust. The latter would require that the torque and thrust be transmitted through the entire length of the drill string 13, including the curved portion shown. Thus, since the string 13 is horizontal to the right of the curved portion, it can be appreciated that the thrust component transmitted to drill head 14 would be approximately zero.

The flexible shaft drill string 13 extends downwardly from housing 20 and curves to the right, as aforementioned, to a region remote from hole P. The operation of apparatus 10 is controlled through an electrical cable 24 from a control console (not shown) also remotely located.

Although apparatus 10 is described with respect to support 15 and hydraulic jack 18, it is to be understood that any other suitable supporting apparatus could be used. Alternatively, apparatus 10 may be mounted on a conventional roof bolter vehicle (not shown), with the apparatus supported on a feed arm at the top of the vehicle.

Figure 2:
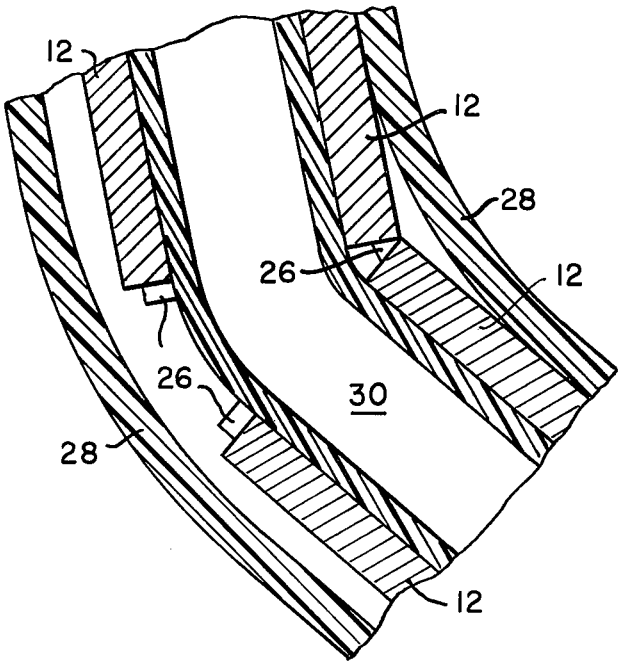
FIG. 2 is a detailed cross-sectional view of a portion of a flexible shaft drill in accordance with the invention.
Figure 3:
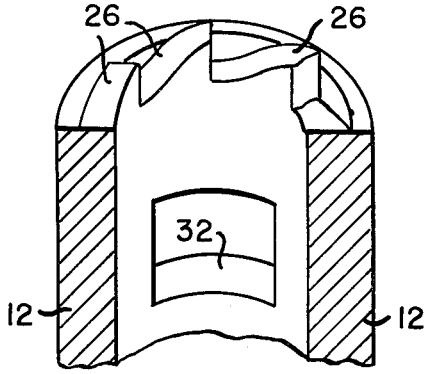
FIG. 3 is a perspective view of a drill shaft segment, with portions cut away to expose its interior.
Figure 4:
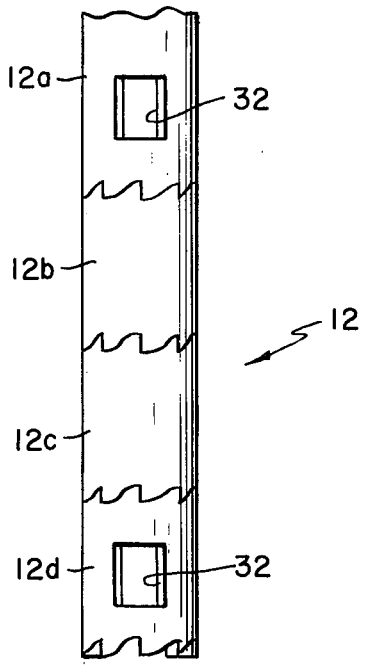
FIG. 4 is a view of several drill shaft segments coupled together for drilling.

Referring to FIGS. 2–4, flexible shaft drill string 13 comprises a series of drill segments 12, such as segments **12*a*–12*d* in FIG. 4. As best shown in FIGS. 3 and 4, each drill segment 12 is formed of a hard metal, hollow cylinder with a pair of opposed, square apertures 32 in the wall of the cylinder (only one square aperture shown in FIG. 3) and only two apertures are shown in FIG. 4 for simplicity. A series of ratchet teeth 26 is formed on each of the opposite rims of the segments (see FIG. 4**).

Drill segments 12 are connected end-to-end with teeth 26 of adjacent segments engaging each other for common rotation. Although each segment 12 is rigid, the coupling formed by teeth 26 permits the drill string 13 to snake along a curved path (see FIG. 2). As the string 13 snakes around a curve, as shown, at least a portion of the teeth 26 of adjacent ones of drill segments 12 is always maintained in engagement for transmitting torque along the entire string.

The drill string segments 12 are contained within an elastic sleeve 28 formed of, e.g., Teflon. The outer sleeve 28 protects the segments 12 from the environment, and maintains them in proper alignment to each other.

Another resilient sleeve 30 is contained within the segments 12. Inner sleeve 30 helps maintain the drill segments 12 in alignment to each other and also serves as a conduit for collecting chips cut from the rock during drilling, and for transferring the chips to a region remote from the portion of the roof surface being drilled. Inner sleeve 30 is maintained under partial vacuum by a source of negative pressure (not shown) connected to the tail end of the inner sleeve.

Figure 5:
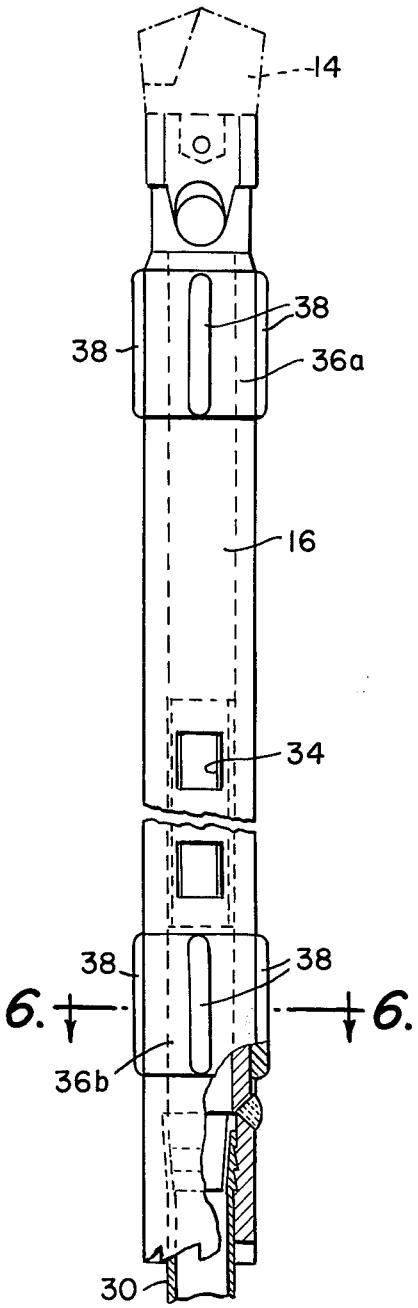
FIG. 5 is a view of a starter section, drill head, and guide sleeves in accordance with the invention.

Referring to FIG. 5, the working end, or head 14 of drill string 13 comprises a cutting member attached to a rigid, starter section 16. Starter section, which in practice has a length of approximately 12–15 inches, is formed of a single piece. The starter section 16 is hollow for transferring chips between drill head 14 and chip return line 30. The starter section 16 also contains a series of apertures 34, similar to the apertures 32, shown in FIG. 4. The apertures 34, as well as apertures 32, receive pawl members 62 (FIG. 7) to provide a pawl and ratchet function for driving drill string 13 as described in more detail below.

Figure 6:
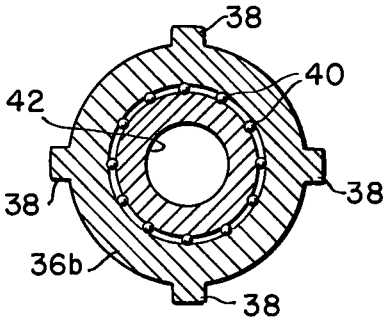
FIG. 6 is a cross-sectional view of a guide sleeve taken along the line 6—6 of FIG. 5.

Guide sleeves **36*a* and 36*b* are located respectively at the upper and lower ends of starter section 16. Each guide sleeve 36*a* and 36*b* contains a series of four vertical ribs equispaced along the outer surface of the sleeve (see also FIG. 6). The sleeves 36*a* and 36*b* are mounted to starter section 16 with ball bearings 40 to permit the starter section to freely rotate while the sleeves are moved only axially within the rock. In operation, starter section 16 is aligned at the surface of the rock at the proper location and the entire drill string 13 is rotated. During rotation, starter section 16 is advanced into the rock until upper guide sleeve 36*a* engages the surface of the rock. Then, the upper sleeve 36*a* is further advanced up into the rock with ribs 38 engaging the wall of the hole. The ribs 38 prevent the upper sleeve 36*a* from rotating with the starter section 16, but cause the section to advance through the rock along a straight line path. As the starter section 16 continues to advance into the rock, the lower guide sleeve 36*d* also enters the hole, and ribs 38** on the lower sleeve also help guide the starter section along the straight line path.

During drilling, the chips cut from the rock are drawn down through inner channel 42 of the starter section 16 to the chip return line 30.

The combination of the rigid starter section upper and lower guide sleeves 36a and 36b, and the vertical alignment provided by drive mechanism 10 ensure that the drill string 13 is oriented nearly perfectly vertical for drilling a vertical long hole, and this expedites the roof bolting operation.

As aforementioned, apparatus 10, shown in FIG. 1, located directly under the hole to be drilled, supplies thrust and torque to head 14 at only a straightened portion of the flexible shaft drill string to rotate the string while advancing it upwardly into the hole. The uppermost portion (starter section 16) of the drill string 13 is directed straight into the roof surface as apparatus 10 straightens the segments 12 of the drill string 13 and guides them perpendicular to the roof as the string is advanced into the hole.

Figure 7:
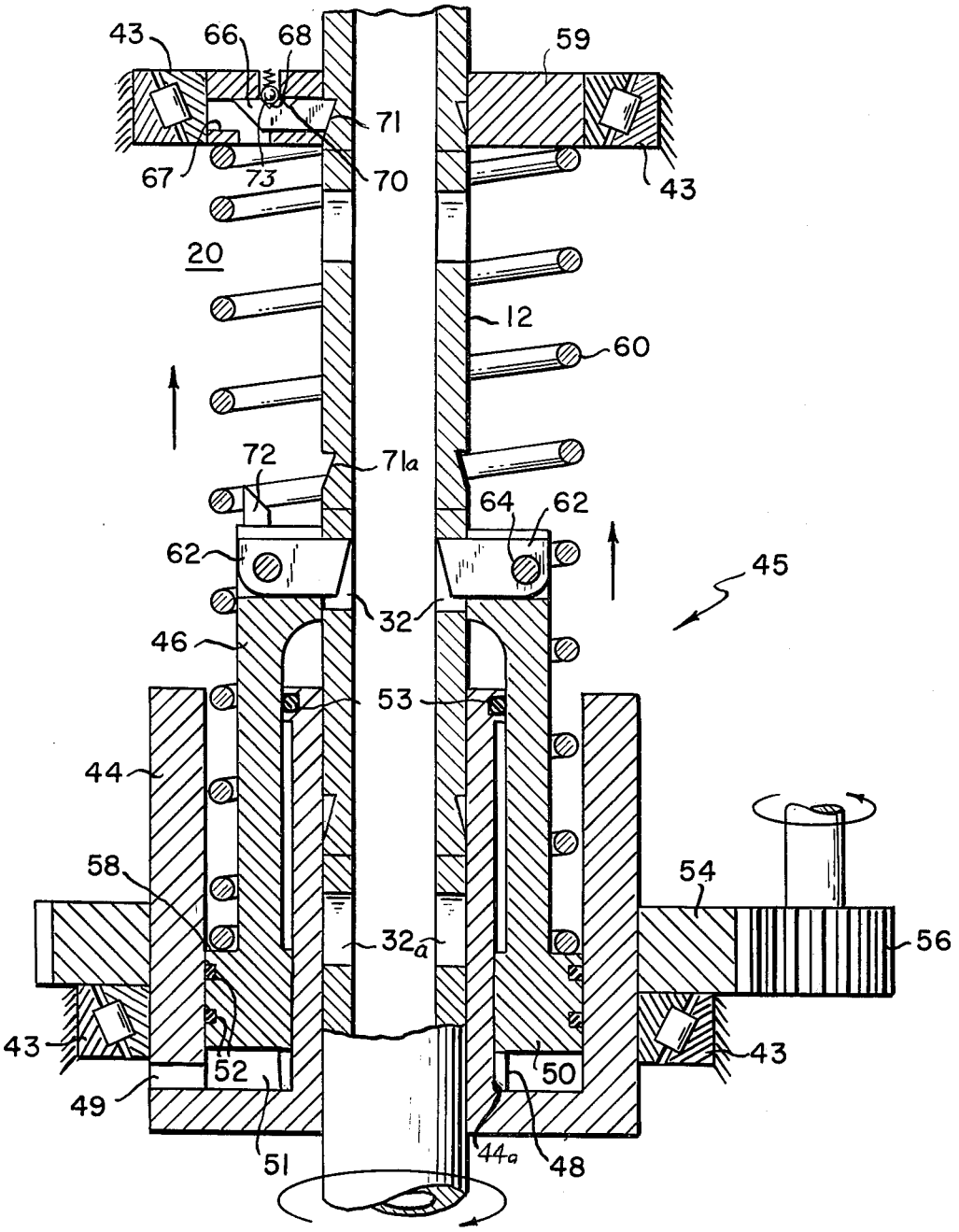
FIG. 7 is a cross-sectional view of the drive mechanism contained within the housing shown in FIG. 1.

Referring now to FIG. 7, a drive mechanism 45, contained within housing 20 (FIG. 1) for simultaneously rotating and advancing drill string 13 (sleeves 28 and 30 not shown for simplicity), will now be described in detail. Drive mechanism 45 is mounted in housing 20 on upper and lower bearings 45 (housing 20 is not shown in FIG. 7). The drive mechanism 45 comprises a rotatable, double-walled cylinder 44 containing a piston 46. The surface of inner wall 44a of cylinder 44 contains vertical grooves or splines 48 extending to the upper outwardly extending lip of the cylinder just below seal 53, as shown, for receiving legs 50 of the piston 46. Thus, piston 46 is freely movable in a vertical direction within the cylinder 44, but is caused to rotate along with the cylinder.

A ring gear 54 is secured to the outer wall of cylinder 44, and is rotated by a pinion 56 that is in turn rotated by motor 22 (FIG. 1). Accordingly, motor 22 causes cylinder 44 to rotate. In addition, as will be described in detail below, hydraulic pressure supplied to chamber 51 between the piston 46 and cylinder 44 causes the piston to reciprocate within the cylinder. The piston 46 thus reciprocates and rotates simultaneously to drive drill string 13 into the rock.

A pair of pawl members 62 are attached to the upper portion of piston 46 on pivots 64. Pawl members 62 engage with apertures 32 formed in drill string 13, and the pawl members and apertures function as a pawl and ratchet mechanism for both rotating the drill string and advancing it up into the hole. With the pawl members 62 engaged in apertures 32, as shown in FIG. 7, the drill string 13 is caused to rotate with piston 46 and cylinder 44. Hydraulic pressure from a source (not shown) is supplied to chamber 51 between piston 46 and cylinder 44 through an annular port 49 formed in the cylinder. Although not shown, a rotary seal is provided at the inlet of port 49 to hold pressure in the chamber 51 during rotation of cylinder 44. The hydraulic pressure supplied to chamber 51 forces piston 46 upwardly during rotation in sliding contact with ring member 53 on cylinder 44. O-ring seals 52 on leg 50 of piston 46 prevent leakage between the leg and cylinder wall.

During an up-stroke of piston 46, the pawl members 62 engage in apertures 32 in the drill string 13 to thrust the string upwardly (the drill string is simultaneously rotating). As this happens, a holding pin 66 slidably mounted in housing 20 adjacent upper left-hand bearing 43, is deflected out of a notch 71 formed in at least some of the segments 12 of the drill string 13 (FIG. 7). The pin 66 is thus indexed to the left from the position shown to release the segments 12. As pin 66 is indexed, member 73 indexes from V-shaped groove 68 in the pin 66, to the V-shaped groove 70.

The piston 46 is driven to the top of its stroke, and an indexing member 72, attached to the top of the piston 46, enters chamber 67. The cam surface of indexing member 72 strikes holding pin 66 forcing the pin to the right in engagement with notch 71a formed in a lower segment 12, as shown. Member 73 is then indexed back to groove 68. The pin 66 engaged in notch 71 maintains the drill string 13 up into the hole independently of pawl members 62.

Hydraulic pressure is then removed from chamber 51, and a return spring 60 located between upper surface 59 of housing 20 and upper surface 58 of the leg 50 of piston 46, returns the piston back to the bottom of its stroke (the position shown in FIG. 7). As the piston 46 is forced downwardly by spring 60, pawl members 62 automatically disengage from apertures 32. When the piston 60 has reached the bottom of its stroke, pawl members 62 engage with a lower set of apertures 32a formed in the drill string 13. Since the piston 60 is continuously rotated during stroking, at the bottom of the stroke, pawl members 62 slide along the outer surface of the drill string 13, and slip down into apertures 32a in a segment 12 when pairs of apertures and pawl members are coincident. The drive mechanism 42 is then readied for another stroke.

In summary, I have described a system for drilling long holes in a mine roof where the working distance perpendicular to the roof is limited. I provide a flexible shaft drill string 13 comprising a plurality of drill shaft segments 12 connected end-to-end. The flexible shaft drill string 13 is fed to a drive mechanism 42 located directly under the hole to be drilled, and the mechanism simultaneously rotates the drill string and advances it into the hole. At least two of the segments 12 are contained within the cylinder 44 at one time, and this straightens the drill string segments at the working surface of the rock, and guides the string vertically. The drill string 13 includes a rigid starter section behind head 14, and has a pair of freely rotatable guide sleeves 36a and 36b for guiding the string along a straight line in the rock. A chip return line 30, contained in the drill string 13, is maintained under negative pressure to draw chips of rock away from the head of the drill. The tail end of the drill string curves below the drive mechanism and extends to a region remote from the working area. The mechanism 42 is controlled at the remote area to ensure safety of personnel.

In this disclosure, there is shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. An apparatus for drilling long holes in a surface of a rock bed wherein a working distance perpendicular to the surface is limited, comprising:

a flexible drill string having a head, said drill string being formed of a plurality of rigid drill segments in end-to-end engagement to each other; and means located at said surface directly below a hole to be drilled for straightening a portion of said drill string and guiding said straightened portion perpendicular to said surface, a remaining portion of said drill string extending away from said means along an arcuate path;

said means including means for applying thrust and torque directly to the straightened perpendicular portion of said drill string for drilling into said surface, a resultant thrust applied to the drill head thereby being maximized with minimim wear on the drill string;

said remaining portion of said drill string feeding to said straightening and guiding means along the arcuate path during drilling.

2. The apparatus of claim 1, wherein each of said drill segments includes first and second rims having teeth formed in said rims, the teeth formed on the first rim of each segment engaging with the teeth formed on the second rim of an abutting drill segment for common rotation of said segments.

3. The apparatus of claim 1, including a longitudinal channel formed within said drill segments; and a chip return path contained within said channel for returning chips cut from said rock bed by said drill string.

4. The apparatus of claim 1, wherein said means for supplying thrust and torque includes a rotatable piston releasably coupled to said drill string; first means for rotating said piston; and second means for stroking said piston perpendicular to said surface during rotation of said piston.

5. The apparatus of claim 4, including a pawl member mounted to said piston, at least some of said drill segments containing an aperture for engagement by said pawl member.

6. The apparatus of claim 5, including holding pin means for maintaining said drill string within the hole being drilled when said pawl member is disengaged from said aperture.

7. The apparatus of claim 6, wherein said holding pin means is engagable with a recess formed in at least some of said drill segments, said holding pin means being disengaged with respect to said recesses during up-stroke of said segments.

8. The apparatus of claim 7, including an indexing member secured to said piston for contacting said holding pin means when said piston is at an upper end of a stroke.

9. The apparatus of claim 4, including a chamber formed between said piston and said cylinder for receiving hydraulic pressure to up-stroke said piston.

10. The apparatus of claim 4, including a cylinder, said piston being rotatably mounted within said cylinder, and sealing means formed between said cylinder and said piston.

11. The apparatus of claim 10, including a pinion gear; and a ring gear secured to said cylinder, said pinion gear and ring gear in engagement with each other for rotation of said cylinder in response to rotation of said pinion gear.

12. The apparatus of claim 11, including spring means in contact with said piston for downwardly biasing said piston within said cylinder.

13. The apparatus of claim 1, wherein said drill string includes a rock cutting head, and a rigid starter section located between said head and drill segments for guiding said drill string along a straight line path in the rock.

14. The apparatus of claim 13, wherein said starter section includes a sleeve rotatably mounted on said section, an outer surface of said sleeve including a plurality of longitudinal elongated fingers for guiding said drill string within the rock.

15. The apparatus of claim 13, wherein said starter section includes a pair of sleeves located respectively at each end of said section, said sleeves rotatably mounted on said section and containing a plurality of longitudinal elongated fingers for guiding said drill string within the rock.

16. The apparatus of claim 15, wherein each of said sleeves is mounted on ball bearings.

17. A method of drilling a long hole in a surface, where a working distance perpendicular to the surface is limited, including the steps of straightening a portion of a flexible drill string formed of a plurality of rigid drill segments in end-to-end engagement to each other, perpendicular to the surface; extending a trailing portion of said string non-perpendicular to the surface; contacting the straightened portion of the drill string to a driving member; operating the driving member for supplying torque directly to the straightened portion of said drill string for rotation; and further operating the driving member for supplying thrust directly to said straightened portion for advancing said drill string into the surface for drilling.

18. The method of claim 17, wherein the steps of supplying are performed directly under the hole to be drilled and adjacent the surface.

* * * * *